United States Patent [19]

Weigl et al.

[11] 4,014,563

[45] Mar. 29, 1977

[54] RUN-AWAY PREVENTING DEVICE FOR SKIS

[75] Inventors: Erwin Weigl, Brunn am Gebirge; Josef Svoboda, Schwechat, both of Austria

[73] Assignee: Gertsch AG, Baar, Zug, Switzerland

[22] Filed: Dec. 10, 1975

[21] Appl. No.: 639,385

[30] Foreign Application Priority Data

Mar. 7, 1975 Austria ..... 1803/75

[52] U.S. Cl. ..... 280/605

[51] Int. Cl.[2] ..... A63C 7/10

[58] Field of Search ..... 280/605, 604

[56] References Cited

UNITED STATES PATENTS

| | | | |
|---|---|---|---|
| 3,715,126 | 2/1973 | Schwarz | 280/605 |
| 3,724,867 | 4/1973 | Hawthorne | 280/605 |
| 3,884,487 | 5/1975 | Wehrli | 280/605 |

*Primary Examiner*—Robert R. Song
*Assistant Examiner*—David M. Mitchell
*Attorney, Agent, or Firm*—Woodhams, Blanchard and Flynn

[57] ABSTRACT

Run-away preventing device for skis. A pair of prongs are pivotally mounted at each side of a ski for alternately occupying an inactive position alongside of and parallel with the ski or an active position projecting downwardly from the ski. A generally U-shaped member is connected to said prongs and lies against the upper surface of the ski and under the ski boot when the latter is in position on the ski. Said U-shaped member is so arranged as to be subjected to tension when pressed down against the ski by the ski boot with such tension being relieved when same is permitted by removal of the ski boot to spring up away from the ski and move said prongs into the above-mentioned active position. Said generally U-shaped member and the prongs connected thereto comprise only a single movable part and hence combine a minimum of parts with a maximum of reliability.

7 Claims, 5 Drawing Figures

RUN-AWAY PREVENTING DEVICE FOR SKIS

FIELD OF THE INVENTION

The invention relates to a run-away preventing device for skis, which includes a bar which is pivotally supported on the ski, which bar can be moved under spring action automatically into a braking position and in this position projects over the ski with the brake legs thereof directed downwardly.

BACKGROUND OF THE INVENTION

A run-away preventing device having a rotatably supported holding bar and a cross support which lies perpendicularly with respect to the longitudinal axis of the ski is already known, the two wings of said cross support being arranged on the sides of the ski. This run-away preventing device can be rotated under spring action into a braking position, in which the wings project substantially vertically from the ski downwardly, and in which the wings are hinged on pins which in turn are mounted on the sides of the ski. One or more tension springs are secured at one end on the wing and at the other end eccentrically on the pin. Such ski brakes are expensive and the operation of the springs can be easily affected by outside influences like ice, dirt, snow, dust and the like.

Further, the market already offers a ski brake provided with a multiple-wound spring wire. The ends of the spring wire form herein the brake legs and the wound portion, mounted on the ski under a plate, form in effect, due to their sloped position, torsion springs which are not greatly subject to external influences. However, it is not possible in a simple manner to increase the strength of the brake legs by increasing the spring wire dimension, because then the spring force also becomes too great and in the condition of use wherein the spring legs are held in an upwardly swung position by the ski boot, the force of the ski brake onto the ski boot becomes excessive. Thus, this run-away preventing device is limited in its dimensions.

SUMMARY OF THE INVENTION

The purpose of the invention is to avoid these disadvantages and the invention is characterized by providing each brake leg with two extensions, of which one extends below a holding plate secured on the ski and thereafter extends to a stepping plate and the second one extends directly to the stepping plate.

Thus, each brake leg can be formed of two parts wherein the second part beard directly onto the stepping plate. This results in virtually a doubling of the stability of the brake legs. Further, the second extensions not only reinforce the brake legs but because of the lever conditions so provided, the stresses on the individual parts are reduced.

BRIEF DESCRIPTION OF THE DRAWINGS

The subject matter of the invention is illustrated exemplarily in one embodiment in the drawings, in which.

DETAILED DESCRIPTION

Figure 1:
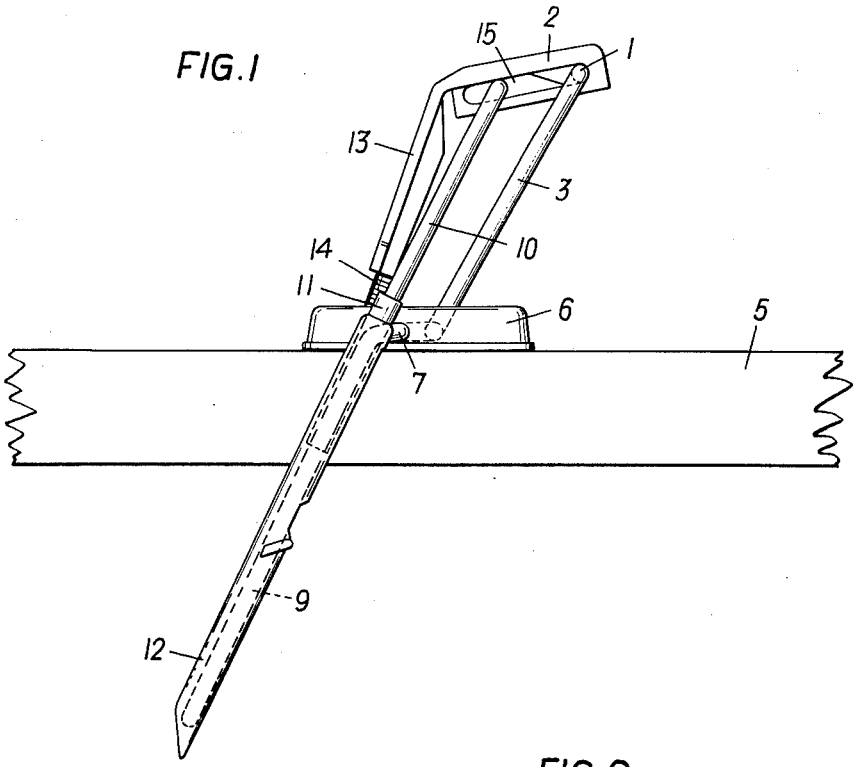
FIGS. 1 and 2 are associated views of a ski brake of the invention in braking position.

As appearing in the drawings, the cross part 1 of an approximately U-shaped spring wire is hingedly fastened to a stepping plate 2. The spring wire extends with its legs 3 through a center recess 4 of a holding plate 6 which is secured on the ski 5. The spring wire then extends by outwardly directed bent sections or shanks 7 under the holding plate 6 and is held thereby on the ski 5. Further, the bent sections 8 are associated with reversely bent parts 9 to form the brake legs. The reversely bent parts 9 extend to provide extensions 10 which extend to the stepping plate 2 and are there hinged or guided in slots 15.

The portions 8, 9 of the spring wire, which portions are provided side-by-side and which form the brake legs, are additionally reinforced by a clamp 11 on each side of the ski. Furthermore, the brake legs are additionally encased by a plastic cover 12. A lever arm 13 is hingedly connected to the stepping plate 2 by any convenient means. Said lever arm and stepping plate may be molded as a single part in which the stepping plate and lever arm are designed for appropriate rigidity and in such case same are preferably connected by a web of appropriate flexibility to provide the desired hinged relationship. A polyamide plastic may, for example, be used. Alternatively, the stepping plate and lever arm may be formed rigidly from plastic or metal and connected by any other convenient hinge means, not shown. The lever arm 13 is supported in the center recess 4 of the holding plate 6 by adjustable means 14 which is in turn pivotally supported in the bottom portion of the holding plate 6. Advantageously the part 14 can be a screw pivotally mounted in a socket part **14*a* and threaded into the lever 13**.

When the ski boot is placed onto the skis, the stepping plate 2 is pressed downwardly which causes the device to pivot about the sections 7 of the spring wire. If these shanks 7 were positioned normal to the center axis of the ski, the device could pivot virtually freely and without resistance. However, it can be seen in FIG. 2 that these sections are arranged at an angle to the normal line. This provides a resilient resistance during stepping onto the stepping plate and the device is held by the ski boot against such resilience. If the ski boot is released, the shanks 7, which are under tension, effect a pivoting into the braking position shown in FIG. 1, through which the ski is prevented from undesired further travel.

Figure 2:
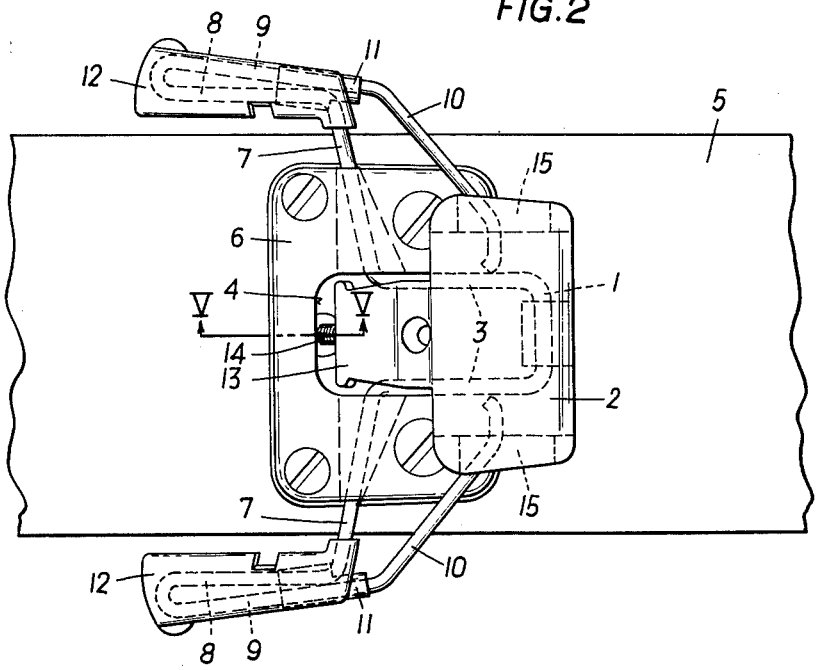
Figure 3:
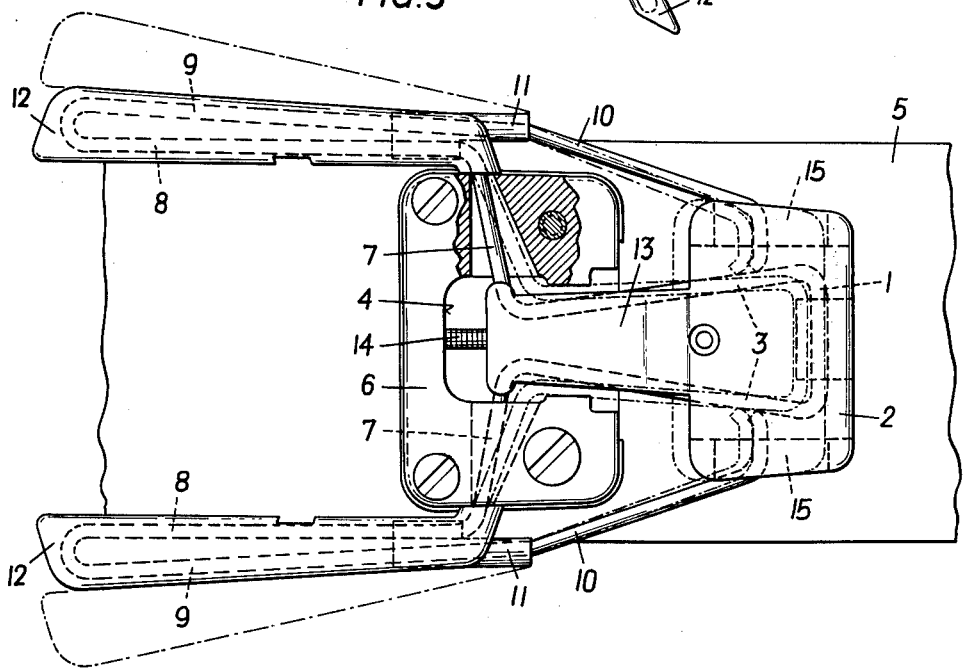
FIG. 3 illustrates the position which the ski brake assumes when the ski boot is placed on the ski.
Figure 5:
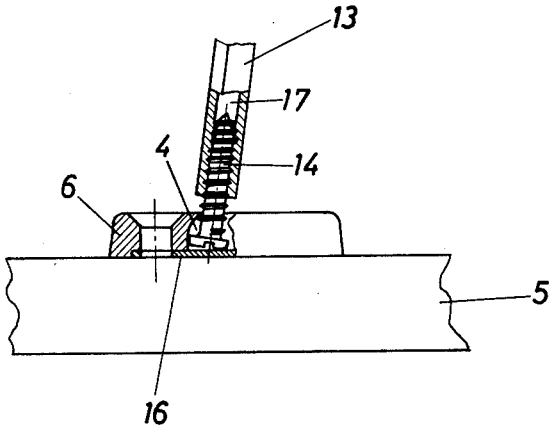
FIG. 5 is a fragmentary section taken on the line V-V of FIG. 2.

The stepping plate 2, and the lever arm 13 which is hinged on it, move on together during a stepping procedure onto the stepping plate until the stepping plate 2 contacts the ski 5. This position is illustrated by dash-dotted lines in FIG. 3. At this point, stepping plate 2 and lever arm 13 still retain an angular position with respect to one another. However, further movement of the ski boot toward the ski causes the stepping plate 2 and lever arm 13 to assume a flattened and hence elongated relationship. Since the adjustable part 14 of the lever arm 13 is supported in the recess 4 of the holding plate 6, the stepping plate 2 extends from the position shown in dash-dotted lines into the position shown in full lines. Since the cross part 1 is fixed with respect to the stepping plate 2, except for permitted pivotal motion therewith, this rearward movement of the stepping plate 2 effects also a corresponding rearward movement of the cross part 1 and the legs 3 associated therewith. The shanks 7, which are retained under the holding plate 6, are not able to directly follow this rearward movement, so that they both move toward the center of the ski and also pivot slightly rearwardly at their inner portions. This causes the brake legs 8, 9 also to swivel inwardly and they come to rest between the ski and the ski boot. Thus, advantageously, during downhill skiing there are no parts which project over the ski or the ski boot. The resilient spring wire, particularly in the region of the shanks 7 is now tensioned and ready for a return to its FIG. 1 position upon removal of the ski boot from the stepping plate 2. When this happens, the legs 8, 9 first swivel outwardly and then downwardly into the braking position resulting in the return of the parts in response to the above-mentioned tension to their initial positions as shown in FIGS. 1 and 2. This constitutes the braking position. Adjustment of the screw 14 changes the angle at which the shanks 7 are positioned and hence changes the spacing of the shanks 8, 9 whereby to accommodate the brake mechanism to skis of varying widths. In addition, though of less importance, such adjustment also changes the tension developed when the ski boot forces the parts into the depressed or cocked position.

Figure 4:
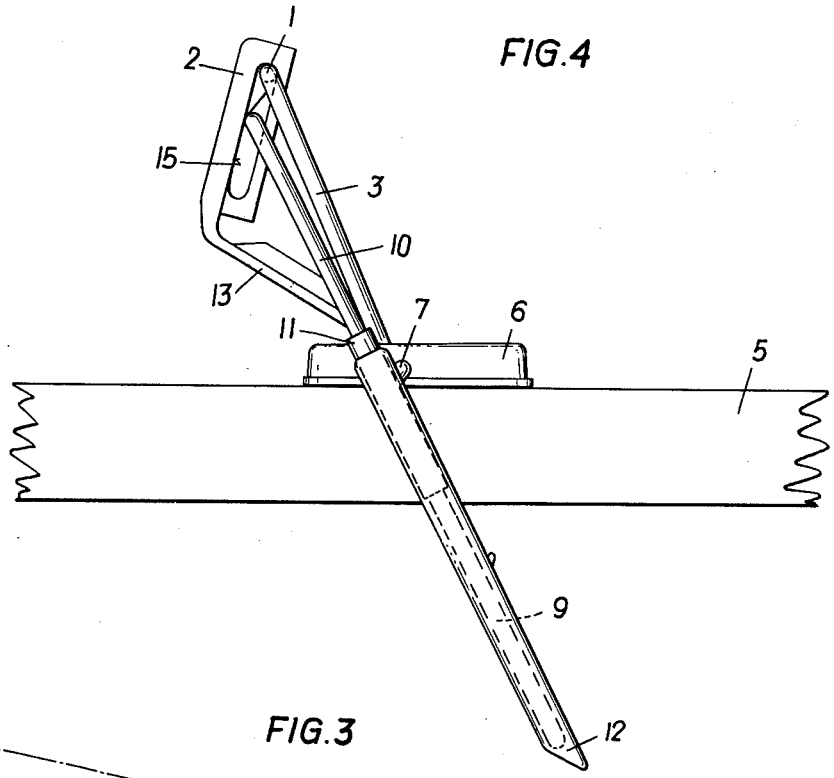
FIG. 4 is a further possible position during a braking operation.

Generally the braking position shown in FIGS. 1 and 2 is assumed. It could happen that one of the brake legs becomes hung up on any kind of obstruction, for example a root. If now the force, with which the ski tends to continue onward, is sufficiently great, damage to the brake or ski is avoided in that the entire device can be tilted forwardly in response to such force, as shown in FIG. 4. When the force is overcome, then the device will spring automatically back into the normal braking position.

The invention is not limited to the illustrated exemplary embodiment. A number of construction possibilities exist, which lie within the scope of the invention. For example, the brake legs could be encircled by a steel encasing, instead of a plastic mass, wherein this encasing could, if desired, be formed in one piece with the reinforcing clamp.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a run-away preventing device for a ski having a bar with brake legs supported on said ski, said bar being movable automatically under spring action into a braking position wherein said brake legs project downwardly from said ski on opposite sides thereof, the improvement comprising a holding plate secured to said ski and a stepping plate pivotally secured to said holding plate, said bar having two extensions extending from each of said brake legs, one of which is pivotally supported on said holding plate and thereafter extends to said stepping plate and the other extension extends directly to said stepping plate.

2. The improved run-away preventing device according to claim 1, wherein said brake legs and said two extensions are formed from one piecee of spring wire.

3. The improved run-away preventing device according to Claim 2, wherein said spring wire of said one extension is constructed U-shaped having a pair of legs and a cross part, said cross part being connected to said stepping plate, said holding plate having a center recess therein through which said legs extend to said brake legs, each of said legs being bent outwardly and extend under said holding plate, said brake legs being integral with said legs and are reversely bent, said spring wire extending directly from said reversely bent part through said other extension to said stepping plate.

4. The improved run-away preventing device according to claim 1, wherein said reversely bent spring wire of said brake legs extend side-by-side and are reinforced by a clamp.

5. The improved run-away preventing device according to claim 4, wherein said brake legs are covered by a mass of material.

6. The improved run-away preventing device according to claim 5, wherein said mass of material is plastic.

7. The improved run-away preventing device according to claim 5, wherein said mass of material is a steel sheet casing.

* * * * *